US008082896B2

(12) United States Patent
Kuhl et al.

(10) Patent No.: US 8,082,896 B2
(45) Date of Patent: Dec. 27, 2011

(54) SWITCHABLE SUPPORT ELEMENT FOR A VALVE TRAIN OF AN INTERNAL COMBUSTION ENGINE

(75) Inventors: Mario Kuhl, Herzogenaurach (DE); Bodo Rorig, Weisendorf (DE)

(73) Assignee: Schaeffler KG, Herzogenaurach (DE)

( * ) Notice: Subject to any disclaimer, the term of this patent is extended or adjusted under 35 U.S.C. 154(b) by 99 days.

(21) Appl. No.: 12/449,888

(22) PCT Filed: Feb. 19, 2008

(86) PCT No.: PCT/EP2008/051996

§ 371 (c)(1), (2), (4) Date: Aug. 28, 2009

(87) PCT Pub. No.: WO2008/110440

PCT Pub. Date: Sep. 18, 2008

(65) Prior Publication Data

US 2010/0089346 A1 Apr. 15, 2010

(30) Foreign Application Priority Data

Mar. 13, 2007 (DE) ..... 10 2007 011 892

(51) Int. Cl.
*F01L 1/14* (2006.01)

(52) U.S. Cl. ..... 123/90.48; 123/90.52; 123/90.55; 74/569

(58) Field of Classification Search ..... 123/90.48, 123/90.52, 90.55; 74/567, 569
See application file for complete search history.

(56) References Cited

U.S. PATENT DOCUMENTS 6,606,972 B2 * 8/2003 Wenisch et al. ..... 123/90.17
6,901,893 B1 6/2005 Gumpher
6,976,463 B2 * 12/2005 Spath et al. ..... 123/90.59
7,308,879 B2 * 12/2007 Hendriksma et al. ..... 123/90.48
2005/0152797 A1 7/2005 Sailer
2007/0006838 A1 1/2007 Hendricksma

FOREIGN PATENT DOCUMENTS

DE 4000531 A1 6/1990
DE 4327905 B4 2/1995
DE 4436952 A1 4/1996
DE 19500575 A1 7/1996

(Continued)

*Primary Examiner* — Ching Chang
(74) *Attorney, Agent, or Firm* — Charles A. Muserlian

(57) ABSTRACT

A switchable support element for a valve train of an internal combustion engine, comprising a housing that can be arranged with an outer peripheral wall in a reception of the internal combustion engine, an axially displaceable pressure piston extending in a bore of the housing, said pressure piston being loaded by a lost motion spring means in a direction leading out of the housing, a head of the pressure piston extending beyond an edge of the housing, and at least one coupling piston extending in a cross-bore of the pressure piston, which can be brought partially into engagement with an entraining surface of the housing for achieving coupling, wherein, starting from an outer front end of the at least one coupling piston, a flattened portion is arranged on an underside of the coupling piston wherein a flattened portion is arranged on an underside of the coupling piston, the entraining surface in the housing per coupling piston is constituted by an underside of a window-like aperture in the bore of the housing, on which underside the at least one coupling piston can be displaced with said flattened portion for achieving coupling, and the pressure piston comprises an anti-rotation device relative to the housing, while the at least one coupling piston comprises an anti-rotation device relative to the cross-bore.

12 Claims, 1 Drawing Sheet

FOREIGN PATENT DOCUMENTS

| | | | |
|---|---|---|---|
| DE | 60111117 | T2 | 3/2001 |
| DE | 101 19 366 | A1 | 10/2002 |
| DE | 102 04 672 | A1 | 8/2003 |
| DE | 10245301 | A1 | 4/2004 |
| DE | 10247949 | A1 | 4/2004 |
| DE | 102005030718 | A1 | 1/2007 |
| EP | 1 149 989 | A | 10/2001 |
| EP | 1526255 | A2 | 10/2004 |
| GB | 2151742 | A | 12/1984 |

* cited by examiner

Fig. 1
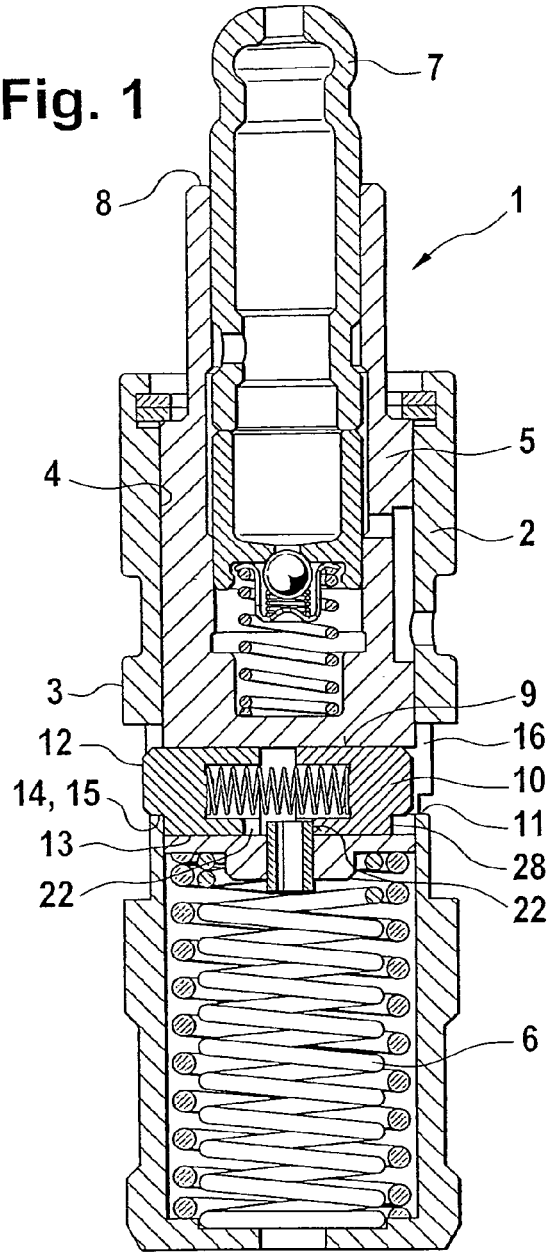
Fig. 2
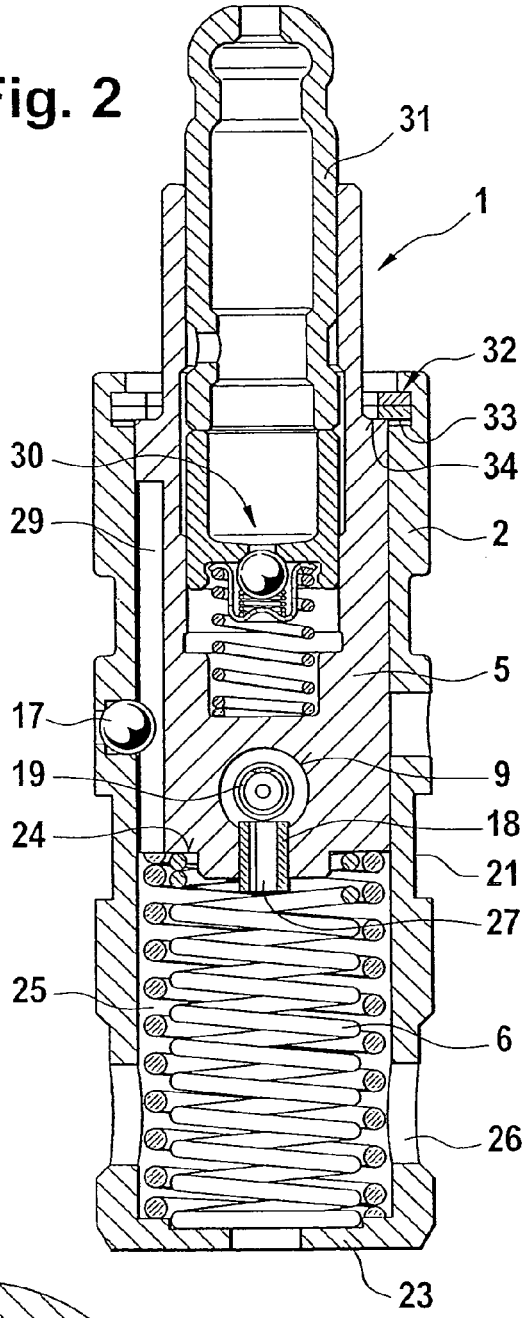
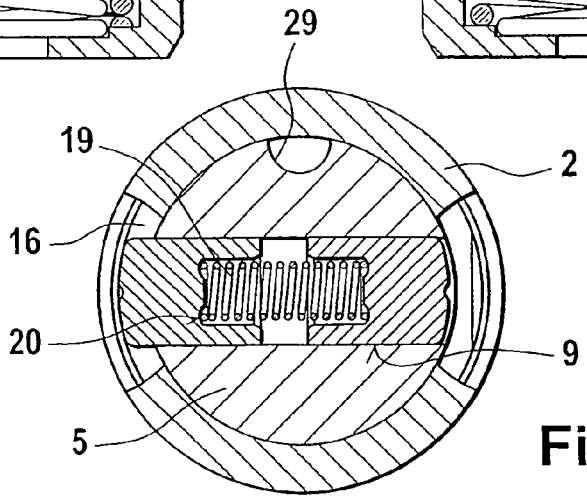
Fig. 3

SWITCHABLE SUPPORT ELEMENT FOR A VALVE TRAIN OF AN INTERNAL COMBUSTION ENGINE

This application is a 371 of PCT/EP2008/051996 filed Feb. 19, 2008.

FIELD OF THE INVENTION

The invention concerns a switchable support element for a valve train of an internal combustion engine, said switchable support element comprising a pot-shaped housing that can be arranged with an outer peripheral wall in a reception of the internal combustion engine, an axially displaceable pressure piston extending in a bore of the housing, said pressure piston being loaded by a lost motion spring means in a direction leading out of the housing, a head of the pressure piston extending beyond an edge of the housing, and at least one coupling piston extending in a cross-bore of the pressure piston, which coupling piston can be brought partially into engagement with an entraining surface of the housing for achieving coupling.

BACKGROUND OF THE INVENTION

Switchable support elements are known from the prior art in which coupling of an at least one coupling piston arranged in the inner element is effected radially outwards into a bore of the housing. It is thus clear that in such a configuration very high demands must be made of positional exactitude to enable an extension of the coupling piston in coupling direction for achieving coupling (s. DE 101 22 373 A1). Besides this, no clear measures for realizing a simple radial inner stop position of the coupling element are provided by this document.

In other known switchable valve train members, the inner peripheral surface of the housing comprises an annular groove into which the at least one coupling piston must be displaced. This annular groove weakens the wall of the housing, so that, where appropriate, the housing must be made with a thicker wall. In addition, because the annular groove extends on the entire circumference, the complexity and costs of making the annular groove in large series are unduly high (transverse feed etc.).

OBJECTS OF THE INVENTION

It is therefore an object of the invention to provide a switchable support element of the pre-cited type in which the aforesaid drawbacks are eliminated by simple measures.

This and other objects and advantages of the invention will become obvious from the following detailed description.

SUMMARY OF THE INVENTION

The invention achieves the above objects by the fact that, starting from an outer front end of the at least one coupling piston, a flattened portion is arranged on an underside of the coupling piston, the entraining surface in the housing per coupling piston is constituted by an underside of a window-like aperture in the bore of the housing, on which underside the at least one coupling piston can be displaced with said flattened portion for achieving coupling, and the pressure piston comprises an anti-rotation device relative to the housing, while the at least one coupling piston comprises an anti-rotation device relative to the cross-bore.

According to another, alternative solution, the invention achieves the above objects by the fact that coupling is achieved through a segmental annular groove. This, too, effectively eliminates the aforesaid drawbacks. In particular, due to the engagement of the coupling piston into a merely window-like aperture, or alternatively into a segmental annular grove, less exactitude is required in the relative angular positioning between the pressure piston and the housing. This obviously has a favorable effect on manufacturing costs.

In the case of the window-like aperture, for example, a simple punching operation can be used. If appropriate, these apertures (preferably two situated diametrically opposite each other for, particularly preferably, two coupling pistons arranged in the radial bore of the inner element) may also be made by a milling method, it being apparent to a person skilled in the art that window geometries diverging slightly from each other are also feasible.

It is likewise preferred to make the undersides of the pistons with a stepped configuration starting from their outer front ends, so that they can engage on a likewise flat counter surface of the window-like aperture, or alternatively of an annular groove segment for effecting coupling. If desired, it is also possible to deviate from the flat engagement configuration and use other geometries such as a dish shape or the like.

If two coupling pistons situated diametrically each other in the radial bore of the inner element are used, loading (contact pressure) in case of coupling is relatively low. If necessary, the invention can also be implemented using only one coupling piston or with more than two coupling pistons. Moreover, it is also possible to provide one pocket bore for each coupling piston in place of the one through-bore in the inner element.

According to a further development of the invention, the coupling pistons are loaded in radially outward direction by a force of a compression spring. In this case, for instance, a simple coiled compression spring (or a coiled compression spring stack) can be used. This is then arranged centrally in the radial bore and acts against inner front ends of the radial pistons.

A displacement of the coupling pistons in radially inward direction can be effected by hydraulic medium routed into the window to the outer front ends of the coupling pistons. For this purpose, for instance, an annular groove can be arranged in the outer wall to intersect the windows, so that an anti-rotation feature for the support element as a whole relative to its reception in the housing can be dispensed with. Where appropriate, an "aligned" installation of the support element in its reception is conceivable and intended, so that no annular grooves are then required for the supply of oil.

Moreover, it is advantageous to provide a vent channel extending centrally out of the radial bore, so that the pistons do not unnecessarily build up an air cushion during their radially inwards directed movement and so that, if necessary, this channel can also be used to drain hydraulic medium.

In this connection, said channel is configured, particularly preferably, as a part of a radial pin that leads centrally out of the radial bore for the coupling pistons and serves at the same time as an anti-rotation device for the coupling pistons relative to their radial bore. For this purpose, the coupling pistons comprise a longitudinal slit and are secured against rotation by the radial pin till they at least start to move onto their entraining surface for achieving coupling.

According to another feature of the invention, it is proposed to use at least one coiled compression spring or one coiled compression spring stack as a lost motion spring which is supported at one end against a bottom of the preferably thin-walled housing and is supported at another end against an underside of the pressure piston. From the space in which the spring is arranged, advantageously, at least one cross-hole leads directly into the open, so that during the lost motion movement of the pressure piston in case of uncoupling air is not unnecessarily compressed.

It is advantageous to provide a stroke limitation for the coupling pistons in radially outward direction. According to another proposition of the invention, this can be achieved by the fact that the stepped regions of the coupling pistons come to abut against an edge section of the bore of the housing to the underside of the entraining surface.

A simple anti-rotation device for the pressure piston relative to the housing is realized, for instance, in the form of an element such as a ball, a needle, a key and slot joint or even through flattened portions or the like.

It is likewise advantageous to arrange the coupling pistons in a bottom-proximate region of the pressure piston, so that sufficient installation space remains above them for an optional arrangement of a hydraulic lash adjusting device.

Insofar as the housing is configured with thin walls and has a tubular shape, it is possible on the one hand to save mass and, on the other hand, the housing can be made by a deep drawing method or by extrusion molding. Alternatively, however, the housing may also have a solid configuration.

According to another feature of the invention, a simple upper vertical stop is constituted by at least one locking ring. This locking ring retains the pressure piston in its "outward direction", so that, when the pressure piston comes to abut against an underside of the at least one locking ring, an excursion of the coupling piston into the window-like aperture is enabled. It is clear that by using locking rings stocked in height groups, an adjustment of a coupling lash can also be effected.

BRIEF DESCRIPTION OF THE DRAWING

The invention will now be described advantageously with reference to the appended drawings.

FIG. 1 shows a longitudinal section through a support element of the invention, FIG. 2 shows a longitudinal section through the support element of the invention, turned through 90° compared to FIG. 1, and FIG. 3 shows a cross-section through the support element of the invention taken in a region of a coupling piston

DETAILED DESCRIPTION OF THE DRAWING

The figures show a switchable support element 1 for a valve train of an internal combustion engine. The support element 1 comprises a hollow cylindrical housing 2 in whose bore 4 a pressure piston 5 is arranged for axial displacement. Through an outer peripheral wall 3 of the housing 2, the support element 1 can be fixedly installed in a reception of an internal combustion engine.

A lost motion spring means 6 (coiled compression spring stack) extends between an underside 24 of the pressure piston 5 and a bottom 23 of the housing 2. The pressure piston 5 further comprises a head 7 which, in the present example of embodiment, is a component part of an inner element 31 of a hydraulic lash adjuster 30, and on which head 7, one end of a lever-type cam follower such as a finger lever can be supported. If appropriate, a rocker arm may also be mounted thereon. Alternatively, the support element 1 may be used as a feed element in a switchable lever valve train.

In a lower region, the pressure piston 5 comprises a through-bore 9 in which, in case of uncoupling, two diametrically opposed coupling pistons 10 are seated. These coupling pistons 10 can be loaded radially outwards through the force of a centrally arranged compression spring 19 acting against inner front ends 20 of the coupling pistons 10.

The through-bore 9 is intersected at a central point, axially downwards by a radial pin 18 comprising a through-channel 27. This through-channel 27 serves for draining air and hydraulic medium into a spring space 25 from which any air situated therein and, if desired, also hydraulic medium can be expelled into the open through a cross-hole 26.

At the same time, the radial pin 18 also serves as a radially inner stop as well as an anti-rotation device for the coupling pistons 10. For this purpose, a longitudinal slit 22 is arranged on the inner front end 22 of each of the coupling pistons 10 and, in case of abutment of the radial pin 18, these longitudinal slits 22 engage partially around the radial pin 18.

Starting from their outer front ends 12, the coupling pistons 10 comprise, on an underside 13, a flattened portion 14. In case of coupling, the coupling pistons 10 can be displaced through these flattened portions 14 onto an underside 15 of a window-like aperture 16 in the housing 2. Said window-like aperture 16 thus extends only as a section on the side of each coupling piston 10. It can be made, for example, by punching-out but also by a simple parallel milling operation. A stop of the coupling pistons 10 in coupling direction is effected by an abutment of their stepped regions 28 in an edge region against the bore 4.

A displacement of the coupling pistons 10 in radially inward direction is effected through hydraulic medium. This can be routed into an annular groove 21 in the outer peripheral wall 3 of the housing 2, which annular groove 21 communicates with the window-like through-apertures 16.

In place of the window-like aperture 16, it is also possible to provide in the bore 4 of the housing 2 on the side of each coupling piston 10, a sickle-shaped annular segment as a coupling surface, into which annular segment the coupling pistons are displaced partially.

Moreover, as can be better seen in FIG. 2, an anti-rotation device 17 (here, a ball) is installed in the bore 4 of the housing 2. This anti-rotation device 17 cooperates with a counter surface 29 (here, a longitudinal slit) for preventing rotation.

An upper vertical stop for the pressure piston 5 in outward direction out of the housing 2 is constituted by a stack of ring parts 32. The pressure piston 5 comes to bear through its shoulder 34 against an underside 33 of the stack of ring parts (here, two arranged on top of each other). At the same time, the stack of ring parts 32 can also serve to adjust a coupling lash by the fact that at least one of the two ring parts arranged on top of each other is stocked in thickness groups (see WO 03/067038 A1).

The invention claimed is:

1. A switchable support element for a valve train of an internal combustion engine, said switchable support element comprising a pot-shaped housing that can be arranged with an outer peripheral wall in a reception of the internal combustion engine, an axially displaceable pressure piston extending in a bore of the housing, said pressure piston being loaded by a lost motion spring means in a direction leading out of the housing, a head of the pressure piston extending beyond an edge of the housing, and at least one coupling piston extending in a cross-bore of the pressure piston, which coupling piston can be brought partially into engagement with an entraining surface of the housing for achieving coupling, wherein, starting from an outer front end of the at least one coupling piston, a flattened portion is arranged on an underside of the coupling piston, the entraining surface in the housing per coupling piston is constituted by an underside of a window aperture in the bore of the housing, on which underside the at least one coupling piston can be displaced with said flattened portion for achieving coupling, and the pressure piston comprises an anti-rotation device relative to the housing, while the at least one coupling piston comprises an anti-rotation device relative to the cross-bore an upper vertical stop for the pressure piston in outward direction out of the housing is constituted by at least one ring part, or through two ring parts arranged on top of each other which is/are seated in an edge-proximate region in the bore of the housing and against whose underside the pressure piston abuts through a shoulder, a stop enabling an excursion of the at least one coupling piston in coupling direction.

2. A support element of claim 1, wherein exactly two coupling pistons are arranged diametrically opposite each other in the cross-bore of the pressure piston, which cross-bore extends in one or radial or secant direction, a displacement of the coupling pistons in coupling direction being effected through a force of at least one compression spring that is seated centrally in the cross-bore and acts through one end against an inner front end of one of the two coupling pistons, and through another end against an inner front end of the other one of the two coupling pistons, and a displacement of the coupling pistons in uncoupling direction can be realized through hydraulic medium that can be routed into an annular groove, or an opening a bore, in the outer peripheral wall of the housing to the outer front ends of the coupling pistons.

3. A support element of claim 2, wherein the anti-rotation device of the coupling pistons relative to the cross-bore, each coupling piston comprising on the inner front end a longitudinal slit complementary in shape to the radial pin, and the coupling pistons engage around a radial pin in case of uncoupling.

4. A support element of claim 3, wherein the lost motion spring means is at least one coiled compression spring which acts at one end against an edge-distal bottom of the housing, and at another end, against a head-distal underside of the pressure piston, and at least one cross-hole leads out of a spring space that is radially surrounded by the housing.

5. A support element of claim 4, wherein a radial pin comprises at least one through-channel extending from the cross-bore into the spring space.

6. A support element of claim 1, wherein the window aperture can be made by one of punching or milling [in a bowstring shape] crosswise to the support element.

7. A support element of claim 1, wherein a stroke limitation for the at least one coupling piston in coupling direction is effected through an abutment of a stepped region of the coupling piston against an edge section of the bore of the housing to the underside of the entraining surface.

8. A support element of claim 1, wherein the anti-rotation device of the pressure piston relative to the housing is constituted by a ball element or a needle element arranged in one of the housing and the pressure piston in a separating region between the pressure piston and the housing, which element is engaged with a respective longitudinally extending counter surface on the other one of the pressure piston relative to the housing, or the anti-rotation device of the pressure piston relative to the housing is constituted flattened regions engaged with one another in the separating region between the housing and the pressure piston.

9. A support element of claim 1 , wherein the cross-bore in the pressure piston is arranged in a region near the underside of the pressure piston.

10. A support element of claim 1, wherein the housing has a thin-walled configuration in form of a tube or pot.

11. A support element of claim 1, wherein the pressure piston comprises a hydraulic last adjuster whose inner element comprises the head.

12. A switchable support element for a valve train of an internal combustion engine, said switchable support element comprising a pot-shaped housing that can be arranged with an outer peripheral wall in a reception of the internal combustion engine, an axially displaceable pressure piston extending in a bore of the housing, said pressure piston being loaded by a lost motion spring means in a direction leading out of the housing, a head of the pressure piston extending beyond an edge of the housing, and at least one coupling piston extending in a cross-bore of the pressure piston, which coupling piston can be brought partially into engagement with an entraining surface of the housing for achieving coupling, wherein, starting from an outer front end of the at least one coupling piston, a flattened portion is arranged on an underside of the coupling piston, the entraining surface in the housing per coupling piston is constituted by an underside of a window aperture in the bore of the housing, on which underside of a segment of an annular groove in the bore of the housing, on which underside the at least one coupling piston can be displaced with said flattened portion for achieving coupling, and the pressure piston comprises an anti-rotation device relative to the housing, while the at least one coupling piston comprises an anti-rotation device relative to the cross-bore. An upper vertical stop for the pressure piston in outward direction out of the housing is constituted by at least one ring part, or through two ring parts arranged on top of each other which is/are seated in an edge-proximate region in the bore of the housing and against whose underside the pressure piston abuts through a shoulder, a stop enabling an excursion of the at least one coupling piston in coupling direction.

* * * * *